US006932217B1

(12) United States Patent
Bailey

(10) Patent No.: US 6,932,217 B1
(45) Date of Patent: Aug. 23, 2005

(54) PAINT BRUSH COVER

(76) Inventor: David Bailey, 4141 Maybelle Ave., Oakland, CA (US) 94619

( * ) Notice: Subject to any disclaimer, the term of this patent is extended or adjusted under 35 U.S.C. 154(b) by 0 days.

(21) Appl. No.: 10/618,911

(22) Filed: Jul. 14, 2003

Related U.S. Application Data

(60) Provisional application No. 60/437,005, filed on Dec. 27, 2002.

(51) Int. Cl.[7] ..... B65D 65/00

(52) U.S. Cl. ..... 206/362.4

(58) Field of Search ..... 206/361, 362.2–362.4, 206/15.2, 15.3, 826

(56) References Cited

U.S. PATENT DOCUMENTS

| | | | | | |
|---|---|---|---|---|---|
| 1,931,293 | A * | 10/1933 | Morck | 206/362.4 |
| 2,290,359 | A * | 7/1942 | Ringler | 206/362.4 |
| 2,609,920 | A * | 9/1952 | Ringler | 206/362.4 |
| 2,841,273 | A * | 7/1958 | Scott | 206/362.4 |
| 3,800,998 | A * | 4/1974 | Gask | 206/362.4 |
| 4,606,456 | A * | 8/1986 | Kaminski | 206/362.4 |
| 5,191,973 | A * | 3/1993 | Shteynberg | 206/362.4 |
| 5,363,959 | A * | 11/1994 | Crosby et al. | 206/362.4 |
| 6,675,966 | B1 * | 1/2004 | Ray | 206/362.4 |

* cited by examiner

*Primary Examiner*—Luan K. Bui
(74) *Attorney, Agent, or Firm*—Harris Zimmerman

(57) ABSTRACT

A paint brush cover which will protect the bristles of a paint brush after it has been used. The cover is formed from a planar sheet of liquid-resistant material and is provided with fold lines about which the sheet may be folded around and releasably secured to at least the bristle portion of the brush.

11 Claims, 3 Drawing Sheets

15
16
23
33
14
40
21
22
13

15
25
44
46
25
42
46
44
22

15
23
33
14
25
25
42
46
44
22

PAINT BRUSH COVER

CROSS-REFERENCE TO RELATED APPLICATIONS

This application is based on and claims priority from my provisional application Ser. No. 60/437,005, filed Dec. 27, 2002.

FEDERALLY SPONSORED RESEARCH

Not applicable.

SEQUENCE LISTING, ETC. ON CD

Not applicable.

BACKGROUND OF THE INVENTION

1. Field of the Invention

The present invention relates to paint brush covers for protecting the bristles of paint brushes, particularly after a brush has been used in applying paint.

2. Description of the Related Art

Typically, after a painter has finished painting, the painter will attempt to remove as much paint as possible from the brush, particularly from the bristles, so that the brush can be used again. Without such cleaning, the paint hardens on the bristles and makes it difficult, or in many cases impossible, to reuse the brush, even when the same color paint is being used. Because of the substantial cost for a good brush, it is not practical to discard the same after s single use.

Frequently, after an oil or a water-based paint brush has been cleaned by thoroughly rinsing the same in water or in an appropriate paint thinner solution, the damp brush may be wrapped in newspaper or foil. Other painters will hang up the brushes by placing a wire or string through an aperture usually found at the distal end of the paint brush handle. Other painters will attempt to replace the brush in the paper cover or holder in which new brushes are usually sold.

However, the prior art is deficient in providing a protective cover which protects the bristles of a wet or damp brush against deformation while drying, which can be repeatedly used, and which permits proper air drying of the bristles.

BRIEF SUMMARY OF THE INVENTION

The present invention generally comprises a water- and oil-resistant cover which substantially encompasses at least the bristle portion of a paint brush, the cover serving to assist in maintaining the bristles in their normal straight condition. The cover is not deleteriously affected by the dampness of the bristles, and can be made in various sizes so as to accommodate the common sizes of paint brushes, e.g., one inch, two inches, etc. Because of the durability of the cover, notwithstanding its relatively low cost of manufacture, the cover may be reused over extended periods of time.

Preferably, the cover is macer of polypropylene PVC material and is approximately 20 mils thick. In its manufacture, the plastic cover may be stamped out in a relatively flat form for economy of manufacture, but is provided with appropriate fold lines so that the flat sheet can be wrapped around the brush and releasably secured in such a protective relationship.

DETAILED DESCRIPTION OF THE INVENTION

Figure 1:
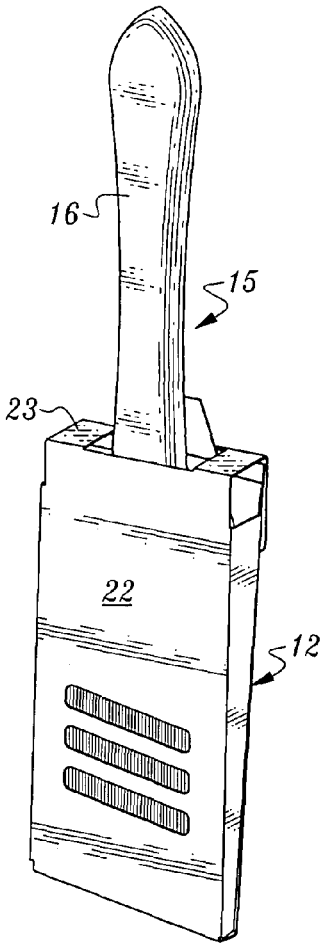
FIG. 1 is a front perspective view of the paint brush cover in operative position on a paint brush.

The cover 12 of the present invention is preferably formed of a generally planar sheet 13 of plastic material such as polypropylene PVC and is approximately 20 mils thick. The plastic is generally impervious to paint, and while having a degree of flexibility, is sufficiently form-retaining so as to protect the bristles 14 of a paint brush 15 when placed in operative condition about the brush 15, as shown in FIG. 1, with the brush handle 16 extending outwardly of the cover. Thus bristle protection is effective even when the brush, with the cover in place, is stored in a position which would normally cause the bristles to be undesirably deformed.

The sheet 13 in the embodiment illustrated has a shape and fold lines presently to be described, so that when folded and releasably secured to a paint brush, the walls and sides of the cover are generally parallel to the handle 16, the top is generally perpendicular to the length of the handle, while the bottom defines an angle of approximately 15° relative to the length or axis of the handle.

Figure 2:
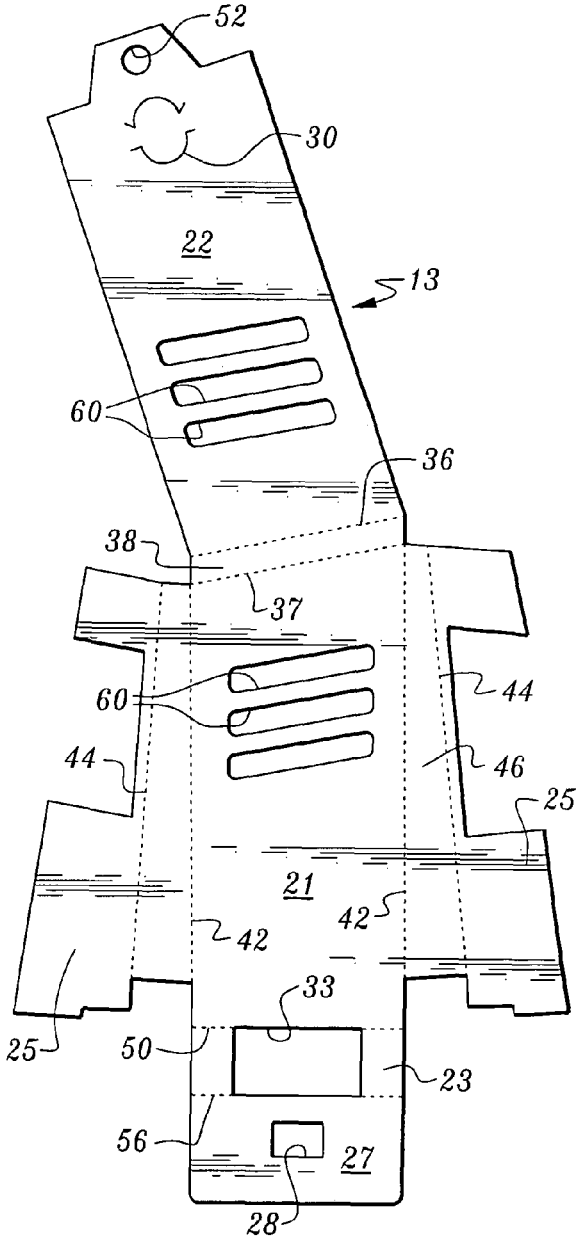
FIG. 2 is a plan view of the cover as manufactured, together with its fold lines, and prior to being folded into an operative position around a paint brush.
Figure 3:
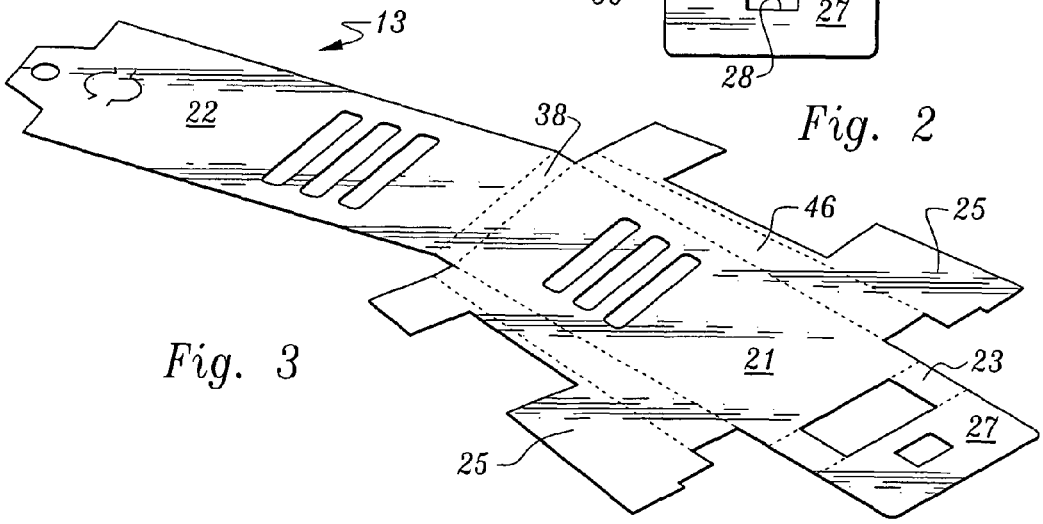
FIG. 3 is a perspective view of the cover as manufactured, but without indicating the fold lines.

Sheet 13, as best illustrated in FIGS. 2 and 3, is a continuous unitary member, and includes a generally rectangular central portion 21 which will constitute the rear wall of the cover; an angularly related generally rectangular portion 22 which will provide the front wall of the cover; a narrow band portion 23 extending from the distal end portion of rear wall 21 which will provide the top of the cover; and wing portions 25 extending outwardly from the edges of rear wall portion 21 which will define the sides or edges of the cover.

Additionally, the sheet has an extension 27 extending from the distal portion of the band or top 23 which includes an aperture 28. This extension and aperture cooperate with tab 29 defined by a pair of arcuate slits 30 located adjacent a distal portion of front wall 22 when the cover encompasses the paint brush. It will be noted that the top 23 of the cover also has a central aperture 33 through which the handle 16 extends when the sheet is folded about the brush.

To permit folding of the generally planar sheet shown in FIGS. 2 and 3 to the cover configuration illustrated in FIG. 1, a pair of spaced parallel fold lines 36, 37 define a narrow band of material 38 which provides the bottom of the cover when the top front wall 22 is folded over the brush whose bristles are supported on rear wall 21.

Figures 4, 5, 6:
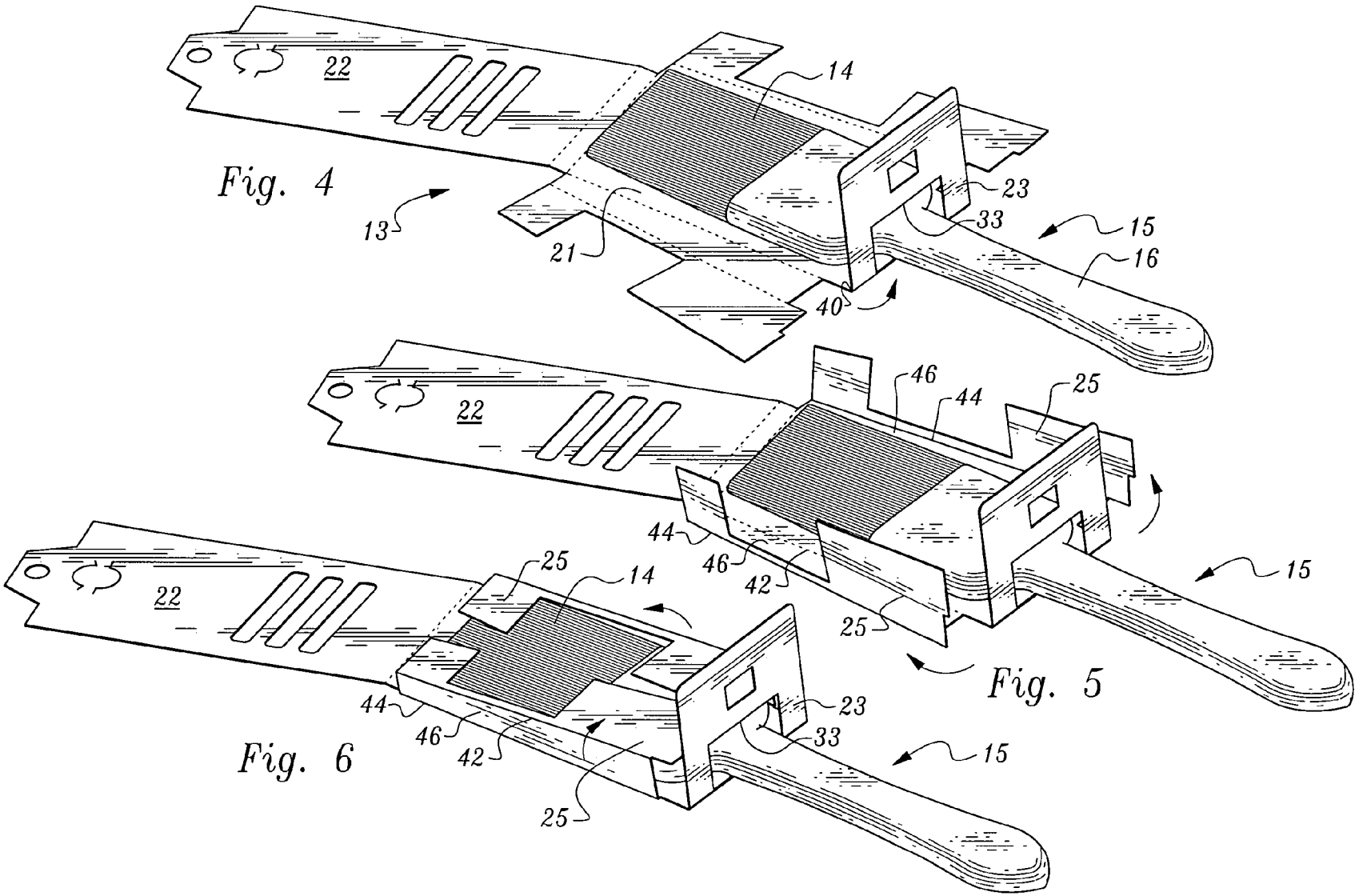
FIGS. 4 through 9 are perspective views indicating how the initially planar member illustrated in FIGS. 2 and 3 is folded around a paint brush to provide the cover shown in FIG. 1.

FIGS. 4 through 10 generally illustrate the preferred sequence in folding the sheet 13 around the brush. FIG. 4 shows the brush supported on rear wall 21 with the handle 16 extending through aperture 33 of top 23 which has been bent upwardly about a fold line 40. Next, the wing portions 25 are folded inwardly about fold lines 42 which define the edges of the rear wall 21. Outwardly spaced fold lines 44 define with the fold lines 40, the edges 46 of the cover, and with the fold lines of each set being slightly divergent from bottom to top, the cover has a slight taper when assembled.

Figure 7:
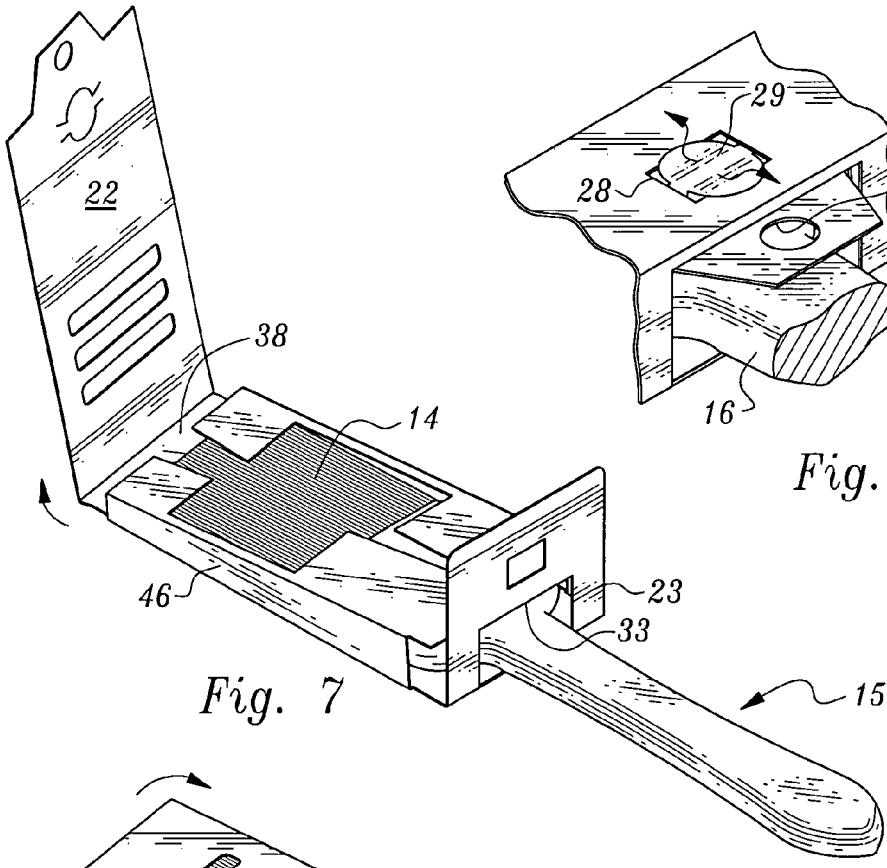
Figure 8:
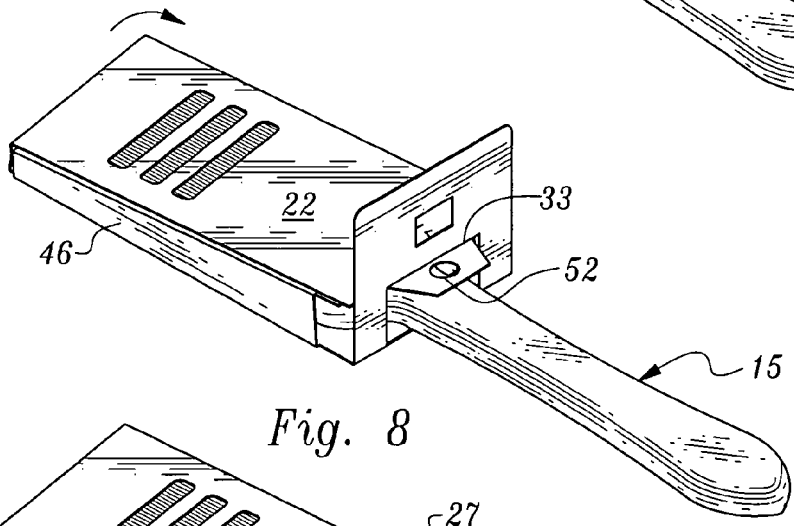

With edges 46 bent generally normal to rear wall 21, the wings 25 may be bent into generally parallel relationship to the rear wall and overlie edge portions of the bristles 14, all as shown in FIGS. 5 and 6. Then, the front wall is bent upwardly about fold line 37 and then bent about fold line 36 to generally lie in overlying relationship to the rear wall 21 and the bristles positioned thereon, all as shown in FIGS. 7 and 8. It may be noted that the distal end 30 of front wall 22 will extend through the aperture 33 and generally overlie a medial portion of handle 16. Such end 30 may be provided with an aperture 52 so that the cover may be hung on a display rack in a planar or a folded condition for display purposes without the paint brush therein.

Figure 10:
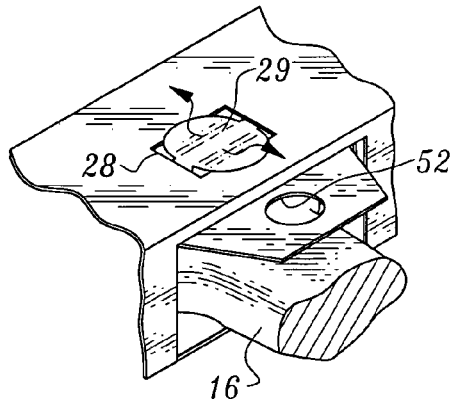
FIG. 10 is an enlarged perspective view of the final releasable locking step to maintain the cover around the paint brush.
Figure 9:
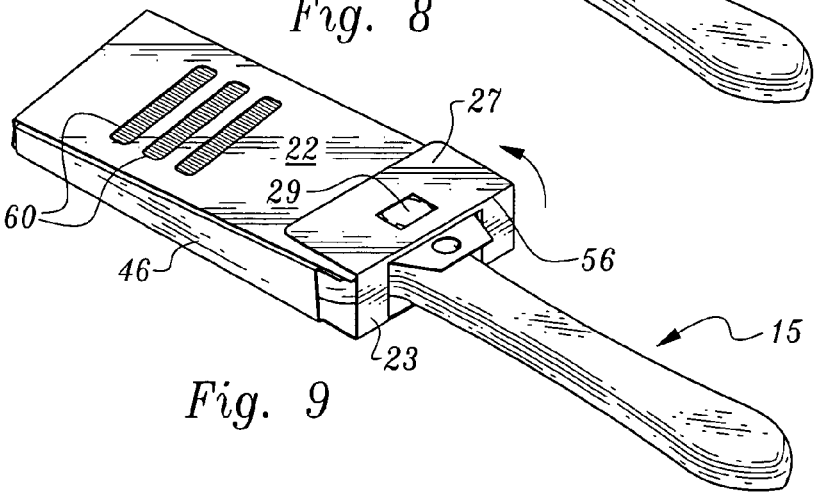

FIGS. 9 and 10 illustrate the locking of the cover by bending the extension 27 about a fold line 56 to overlie that portion of front wall having the tab 29 which may be snapped into the aperture 28 for releasably securing the cover in place.

It should be noted that either or preferably both of the front and rear walls 21 and 22 are perforated as shown at 60 so as to expose the bristles to air.

The foregoing description of the preferred embodiment of the invention has been presented for purposes of illustration and description. It is not intended to be exhaustive or to limit the invention to the precise form disclosed, and many modifications and variations are possible in light of the above teaching without deviating from the spirit and scope of the invention. The embodiment described is selected to best explain the principles of the invention and its practical application to thereby enable others skilled in the art to best utilize the invention in various embodiments and with various modifications as suited to the particular purpose contemplated. It is intended that the scope of the invention be defined by the claims appended hereto.

What is claimed is:

1. A paint brush cover for protecting the bristles of a paint brush which includes a bristle portion and a handle portion, said cover being formed of a generally form-retaining material and adapted to substantially encompass the bristle portion of a paint brush, said cover having a front wall, a rear wall, a bottom, opposed edges, and a top, said top having an opening therein generally medially of said opposed edges through which a handle of a paint brush may extend, said front wall including a distal end portion adapted to extend through said opening and including an aperture adjacent its distal end whereby said cover may be suspended upright on a peg rack, said cover being made of a generally liquid-resistant material, and means for releasably securing said walls, bottom, opposed edges, and top in a closed relationship so as to substantially encompass the bristles.

2. A cover as set forth in claim 1 in which said liquid-resistant material in polyvinyl chloride.

3. A cover as set forth in claim 1 in which said material is approximately 20 mils in thickness.

4. A cover as set forth in claim 1 in which said cover is formed of an integral piece of substantially flat material, and in which said piece of material is provided with fold lines which delineate the respective walls, bottom, opposed edges, and top of the cover.

5. A cover as set forth in claim 1 in which at least one of said front and rear walls is provided with air breathing apertures.

6. A cover as set forth in claim 1 in which said top is provided with an integral extension having an opening therein, a distal portion of said front wall having a tab portion, and said tab portion engaging said extension opening when said cover is folded around the paint brush so as to form said releasable securing means.

7. A cover as set forth in claim 1 in which the spacing between said front wall and said rear wall is greater adjacent said top that adjacent said bottom.

8. A paint brush cover formed from a sheet of generally form-retaining and liquid-resistant material, said sheet having a length greater than its width, a first pair of generally parallel fold lines extending across said sheet whereby said sheet may be folded upon itself with one sheet portion between the fold lines defining a bottom for the cover and a second sheet portion being in spaced relationship to define front and rear walls for the cover, a distal end portion of said rear wall portion having a second pair of generally parallel fold lines spaced inwardly of the end of the sheet whereby said sheet may be folded upon itself with the sheet portion between the second fold lines defining a top for the cover and the portion of the sheet outwardly of said second fold lines defining an extension overlying a distal portion of said front wall, said extension including an aperture, said front wall including a distal end portion adapted to extend through said aperture, said front wall distal end portion including a hole for suspending said cover upright on a peg rack, wing portions extending laterally outwardly from opposed edges of said rear wall and secured to each such wall with a sheet portion defined by a third pair of spaced fold lines whereby said wing portions may be folded inwardly and assume positions in spaced relation to said bottom wall with the sheet portions between said third fold lines defining side edges of the cover.

9. A cover as set forth in claim 8 in which said aperture receives therethrough the handle of a paint brush when said cover is folded about the bristles of a paint brush.

10. A cover as set forth in claim 8 in which said third fold lines taper whereby said side edges are wider adjacent the top of the cover that at the bottom.

11. A cover as defined in claim 8 in which said distal portion of said front wall is provided with a tab, said extension being provided with an opening for engaging said tab when said sheet portions are folded into an operative bristle-encompassing condition.

* * * * *